US005901232A

United States Patent [19]

Gibbs

[11] Patent Number: 5,901,232

[45] Date of Patent: May 4, 1999

[54] SOUND SYSTEM THAT DETERMINES THE POSITION OF AN EXTERNAL SOUND SOURCE AND POINTS A DIRECTIONAL MICROPHONE/SPEAKER TOWARDS IT

[76] Inventor: John Ho Gibbs, 333 S. Clay St., Mooresville, Ind. 46158

[21] Appl. No.: 08/707,308

[22] Filed: Sep. 3, 1996

[51] Int. Cl.[6] ..... H04R 3/00

[52] U.S. Cl. ..... 381/92

[58] Field of Search ..... 381/92, 56, 57, 381/58

[56] References Cited

U.S. PATENT DOCUMENTS

| | | | |
|---|---|---|---|
| 4,037,052 | 7/1977 | Doi | 179/1 MF |
| 4,264,790 | 4/1981 | Zlevor | 179/121 |
| 4,313,183 | 1/1982 | Saylors | 367/128 |
| 4,586,195 | 4/1986 | DeGeorge et al. | 381/92 |
| 4,964,100 | 10/1990 | Srour et al. | 367/178 |
| 5,600,727 | 2/1997 | Dibbald et al. | 381/92 |

*Primary Examiner*—Vivian Chang

[57] ABSTRACT

An acoustical sound system that triangulates the position of an unknown external sound source by computer analysis. The external sound intensity is measured in three fixed sound sensors. The computer inputs the sound intensities and by the inverse square law of intensity vs distance calculates the coordinates of the external sound source. In addition, once the source's position is known, the computer points a paraboloid microphone and speaker combined, towards the direction of the sound source. This allows a more localized bidirectional link between the source and other electronic connection source.

1 Claim, 5 Drawing Sheets

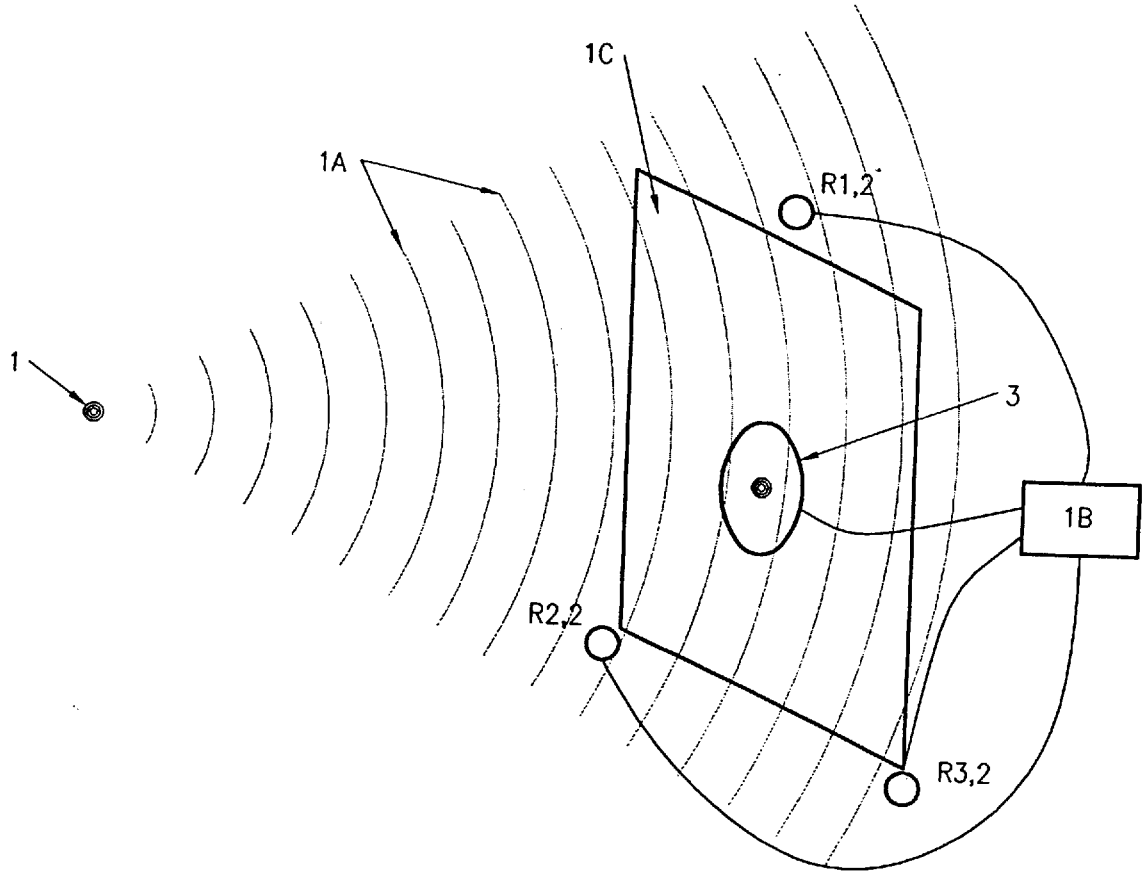
Fig. 1 Global View of System

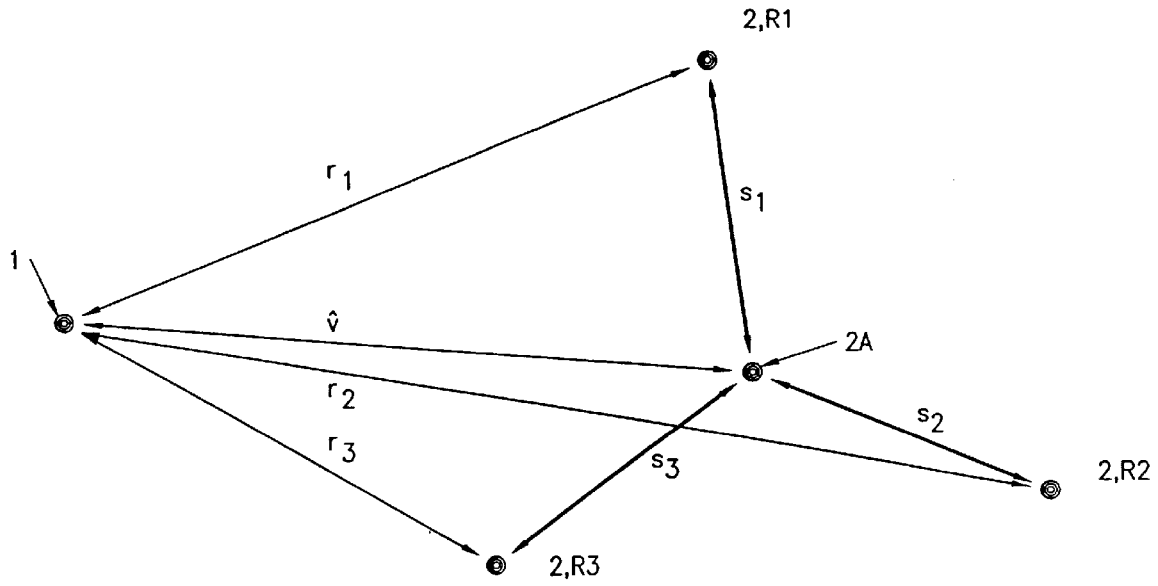
Fig. 2a Geometry (a) $S_i^2 = x_i^2 + y_i^2 + z_i^2$ (b) $I_1 = \frac{C_o}{r_1^2} \quad I_2 = \frac{C_o}{r_2^2} \quad I_3 = \frac{C_o}{r_3^2}$ (c) $r_j^2 = (X - X_j)^2 + (y - y_j)^2 + (z - z_j)^2$ (d) 3 equations $(r_1, r_2, r_3)$ 3 unknowns $(x_k, y_k, z_k)$ $k = 1 \nvdash 2$ (e) $\hat{v} = (x, y, z)$ vector from 2A to 1

Fig. 2B Equations

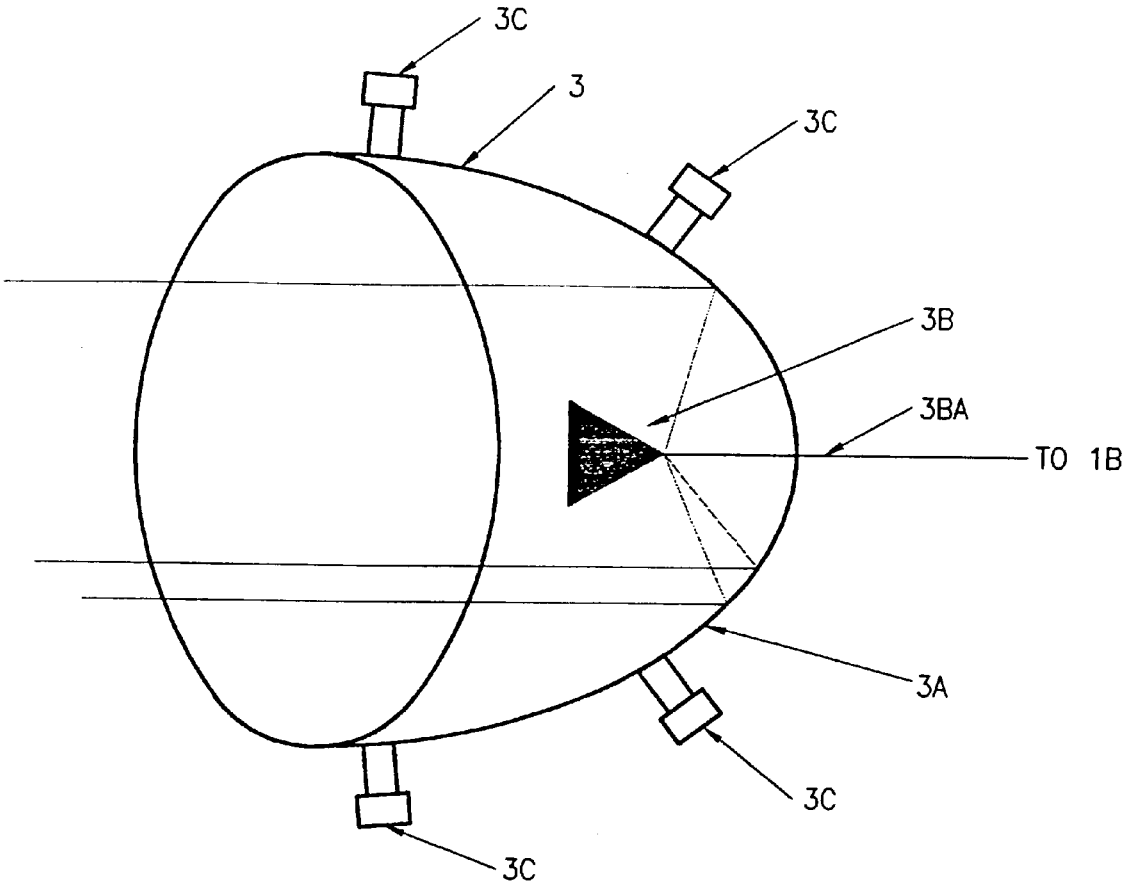
Fig. 3 Parabolic Reciever

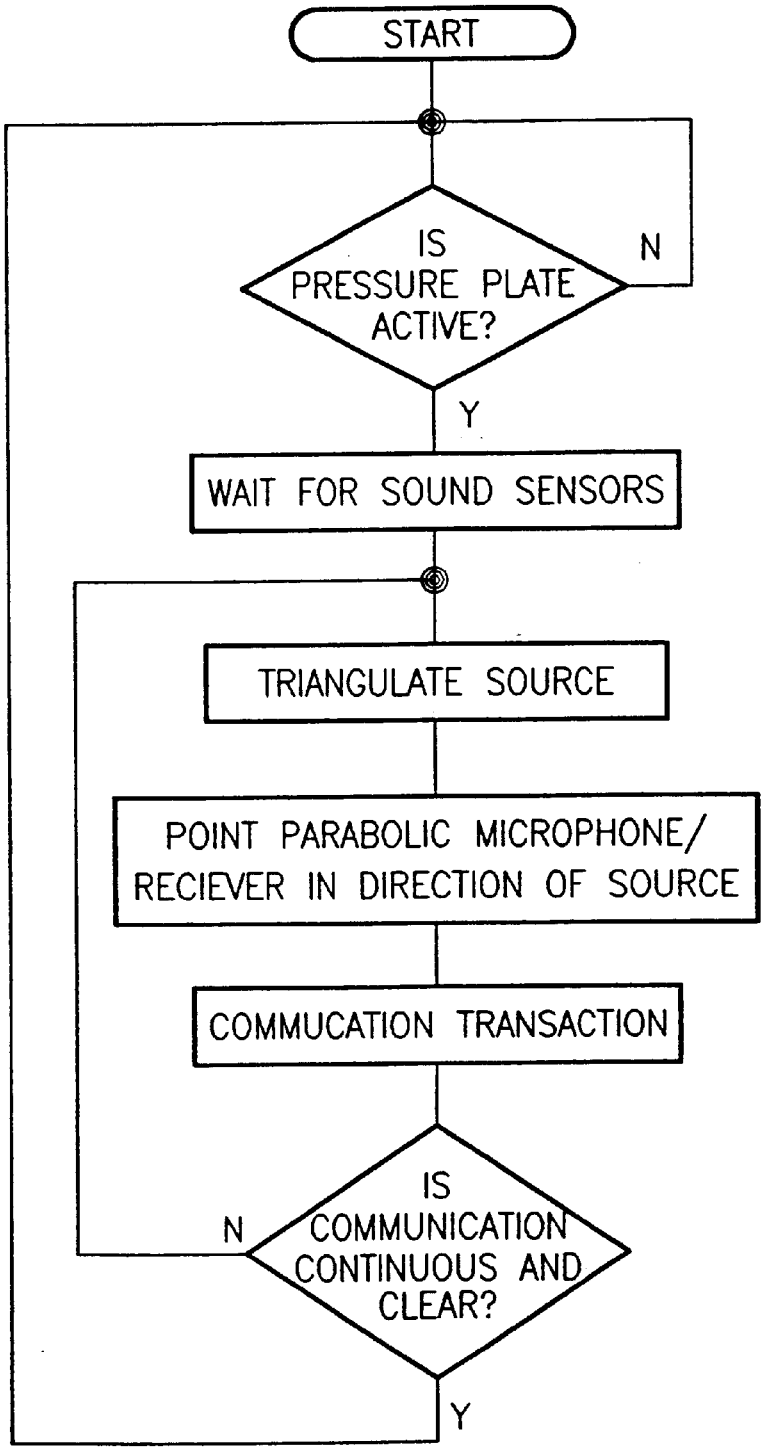
Fig. 4 Flow Chart for Processor

SOUND SYSTEM THAT DETERMINES THE POSITION OF AN EXTERNAL SOUND SOURCE AND POINTS A DIRECTIONAL MICROPHONE/SPEAKER TOWARDS IT

BACKGROUND

1. Field of Invention

This invention relates to drive-up ordering stations in fast food restraints. Specifically to. the sound system of remote ordering by sound speaker & microphone connection.

2. Prior Art

Doi (U.S. Pat. No. 4,037,052) has a paraboloid pickup (microphone) assembly. Srour etal, (U.S. Pat. No. 4,964, 100) has a similar acoustical detector with paraboloid reflector. Zlevor (U.S. Pat. No. 4,264,790) shows a portable directional microphone that has a paraboloid reflector. All of these systems do not have a bidirectional communication of the paraboloid reflector.

Saylors (U.S. Pat. No. 4,313,183) teaches a way to determine distance by sonar methods. However, it does not require triangulation technique.

OBJECTS AND ADVANTAGES

The object of this invention is make two-way sound communication require less effort from the human elements. That is, this sound system makes human communication clearer to understand one another. Conventional microphone & speaker systems use wide angle dispersion of sound for communication. This system uses a paraboloid reflector to narrow the angle and localize the communication.

SUMMARY OF INVENTION

The present invention is a sound system that can triangulate an external sound source's position and then to point a paraboloid microphone/speaker towards that position. This would allow for two people to have two-way communication between the external sound source and the person who is linked to the paraboloid microphone/speaker.

EXPLANATION OF REFERENCE NUMBERS

1 Sound source in vehicle
1A Sound waves in air
1B Computer
1C Menu ordering board
2 Sound receiver sensors
2A Origin of coordinate system
3 Paraboloid microphone/speaker
3A Paraboloid reflector surface
3B Microphone & Speaker combination
3BA Communication wire
3C Positioning motors of reflector surface

DESCRIPTION OF DRAWINGS

FIG. 1 shows the working model of the system. Shown is a car with a person ordering by sound into a menu board.

The menu board has the sound system of sound sensors and a paraboloid microphone/speaker.

FIG. 2A illustrates the geometry of the three sound sensors and the triangulation principle.

FIG. 2B shows the equations necessary for determining the external sound source's position.

FIG. 3 describes the paraboloid microphone/speaker subsystem.

FIG. 4 illustrates the flow diagram for the system's computer.

DESCRIPTION

FIG. 1 shows a global view of the system. A vehicle 1 drives upto a fast food drive up ordering menu board. The pressure plate in the drive way (not shown) is activiated by the vehicle's weight. As a result, the three sound sensors R1,R2 & R3 are activated. These sensors 2 report the sound intensity of the vehicle's sound source 1 to the computer 1B. That is, the sound source 1 of the driver's voice produces sound waves if that intersect the sound sensors 2 (R1,R2 & R3). An analog to digital convertor (not shown) changes the sensors 2 signals into computer language (digital). The computer calculates (see FIGS. 2A & 2B) the voice's position 1 relative to the menu board's coordinate system. After this calculation or triangulation, the paraboloid microphone/speaker 3 (see FIG. 3) is pointed, as a vector, towards the source 1. Since the paraboloid microphone/speaker 3 is bidirectional, a source person to destination person is more localized than any conventional wide angle microphone/speaker system.

FIG. 2A shows the geometry of the triangulation. A source 1 sends sound waves to the sensors 2. (r1,r2,r3) are distances from the source 1 to the sensors (R1,R2,R3) respectfully. These distances are determined by the sound intensities at R1,R2 & R3 from source 1 and sound's inverse square law for intensity vs distance. Likewise, (s1,s2,s3) are the known distances (system installation) to (R1,R2,R3) respectfully. The paraboloid microphone/speaker 3 is identical to the origin's 2A coordinate system. The vector V points from the origin 2A to the source 1.

FIG. 2B are equations of triangulation. (a) is the distance si from the sensors 2 to the origin 2A. That is, (xi,yi,zi) are the origin's coordinates from (R1,R2,R3) to origin 2A. (b) is the intensity to distance relation (ie inverse square law for sound). In an algebraic way (not shown) if sound intensity is known, distance from the source can be known. (c) is the equations of three spheres with there origins being R1,R2 & R3. That is, these equations are spheres that are displaced from the origin 2A by s1,s2 and s3. These three nonconcentric spheres will intersect at two points (atmost). One of these two points will be above ground and the other below ground. The one above will be the source 1 solution for the triangulation. (d) describes the problem statement of 3 quadratic equations (spheres) and 3 unknowns with a set of two solutions. (e) is the vector V from the origin 2A to the source 1. V is the vector that points the paraboloid microphone/speaker 3 towards the source 1 from the origin 2A (where the paraboloid microphone/speaker 3 is located).

FIG. 3 is a close up of the paraboloid microphone/speaker 3. The reflector surface 3A is a finite paraboloid surface of material that can focus, at one point, the plane waves traveling towards the axis of the paraboloid (ie a parabolic curve rotated about an axis forms a paraboloid surface). At the focus 3B is a microphone and a speaker combined into one. This allows the focus 38 to receive waves and transmit waves. The connecting wire 3BA from the microphone/speaker leads into the computer 1B and the remote person (the other two-way communication connection).

The motor 30 moves the paraboloid surface 3A with two dimensional freedom (left-right and up-down). This gives it full directional motion towards the source 1.

FIG. 4 is the flow diagram for the computer's processor 1B. From the start, the question is "Is the pressure plate active?" Or "Has a car drove up to the menu board?" If not then repeat question. If so, activate sound sensors and wait until voice contact is initiated. Next, triangulate the voice with the sound sensors R1,R2 & R3 (see FIG. 2A & 2B). The computer calculates the vector V and points the paraboloid microphone/speaker 3 towards the source by vector V. Begin communicating transaction of ordering unless interrupted or "Is the communication clear?" (or "Has the voice shifted it's position?"). If so, retriangulate source and repeat pointing paraboloid. If communication remains clear and transaction is completed, return back to first question.

What is claimed is:

1. An acoustical system that directionlly locates an unknown external sound source in three dimensional space then points a directional microphone towards said sound source, comprising:

three sound intensity sensors that receives and measures the sound intensity of said sound source;

a directional microphone with known coordinates relative to said three sound intensity sensors;

a computer that inputs said sound sensors' intensity data and calculates the pointing vector from said directional microphone towards said unknown sound source based on the inverse square law for sound insensity;

a plurality of electric motors that point said directional microphone towards said sound source under control of said computer.

* * * * *